US007105989B2

(12) United States Patent
Lamouri et al.

(10) Patent No.: US 7,105,989 B2
(45) Date of Patent: Sep. 12, 2006

(54) PLASMA LAMP AND METHOD

(75) Inventors: Abbas Lamouri, Aurora, OH (US); Juris Sulcs, Chagrin Falls, OH (US)

(73) Assignee: Advanced Lighting Techniques, Inc., Solon, OH (US)

( * ) Notice: Subject to any disclaimer, the term of this patent is extended or adjusted under 35 U.S.C. 154(b) by 118 days.

(21) Appl. No.: 10/776,268

(22) Filed: Feb. 12, 2004

(65) Prior Publication Data

US 2004/0222726 A1 Nov. 11, 2004

Related U.S. Application Data

(63) Continuation-in-part of application No. 10/112,024, filed on Apr. 1, 2002, now Pat. No. 6,897,609.

(60) Provisional application No. 60/446,535, filed on Feb. 12, 2003.

(51) Int. Cl.
*H01J 17/20* (2006.01)
*H01J 61/12* (2006.01)

(52) U.S. Cl. ..... 313/112; 313/113; 313/313; 313/570; 313/635; 313/638; 313/640

(58) Field of Classification Search ..... 313/570–574, 313/110–112, 635, 637–640, 567, 25
See application file for complete search history.

(56) References Cited

U.S. PATENT DOCUMENTS 3,234,421 A 2/1966 Reiling
4,020,377 A 4/1977 Popp et al.
4,315,186 A 2/1982 Hirano et al.
4,330,629 A 5/1982 Hing et al.
4,501,799 A 2/1985 Driessen et al.
5,363,007 A 11/1994 Fromm et al.
5,471,110 A 11/1995 van der Leeuw et al.
5,548,491 A 8/1996 Karpen
5,552,671 A 9/1996 Parham et al.
5,610,469 A 3/1997 Bergman et al.
5,646,472 A 7/1997 Horikoshi
5,694,002 A 12/1997 Krasko et al.
5,751,111 A 5/1998 Stoffels et al.
5,849,162 A 12/1998 Bartolomei et al.
5,961,208 A * 10/1999 Karpen ..... 362/510
6,005,346 A 12/1999 Shaffner
6,072,268 A 6/2000 Dolan et al.
6,229,252 B1 5/2001 Teng et al.
6,294,871 B1 * 9/2001 Scott et al. ..... 313/636
6,323,585 B1 11/2001 Crane et al.
6,605,888 B1 8/2003 Waymouth et al.
6,897,609 B1 * 5/2005 Krisl et al. ..... 313/570

* cited by examiner

*Primary Examiner*—Ashok Patel
(74) *Attorney, Agent, or Firm*—Duane Morris, LLP

(57) ABSTRACT

A plasma lamp and method having high efficacy, high color rendering index, and a desirable correlated color temperature with improved color consistency from lamp to lamp. The lamp may include a vaporizable fill material comprising halides of sodium and scandium and a filter formed from a vitreous material containing a dopant. In one aspect, the filter is formed by a glass shroud containing neodymium oxide that reduces the transmission of yellow light.

31 Claims, 3 Drawing Sheets

Tipless shaped body arc tube

PLASMA LAMP AND METHOD

RELATED APPLICATIONS

This application is a continuation-in-part of U.S. patent application Ser. No. 10/112,024, filed Apr. 1, 2002, now U.S. Pat. No. 6,897,609, and claims the priority of U.S. Provisional Patent Application No. 60/446,535, filed Feb. 12, 2003. The contents of each application is incorporated herein by reference.

BACKGROUND OF THE INVENTION

The present invention generally relates to electric lamps and methods of manufacture. More specifically, the present invention relates to lamps wherein the light source includes a light emitting plasma contained within an arc tube (i.e. plasma lamps) having a filter for improving the operating characteristics of the lamp formed from a glass containing a dopant.

Plasma lamps such as mercury lamps or metal halide lamps have found widespread acceptance in lighting large outdoor and indoor areas such as athletic stadiums, gymnasiums, warehouses, parking facilities, and the like, because of the relatively high efficiency, compact size, and low maintenance of plasma lamps when compared to other lamp types. A typical plasma lamp includes an arc tube forming a chamber with a pair of spaced apart electrodes. The chamber typically contains a fill gas, mercury, and other material such as one or more metal halides, which are vaporized during operation of the lamp to form a light emitting plasma. The operating characteristics of the lamp such as spectral emission, lumens per watt ("LPW"), correlated color temperature ("CCT"), and color rendering index ("CRI") are determined at least in part by the content of the lamp fill material.

The use of plasma lamps for some applications has been limited due the difficulty in realizing the desired spectral emission characteristics of the light emitting plasma. For example, metal halide lamps were introduced in the United States in the early 1960's and have been used successfully in many commercial and industrial applications because of the high efficiency and long life of such lamps compared to other light sources. However, metal halide lamps have not as yet found widespread use in general interior retail and display lighting applications because of the difficulty in obtaining a spectral emission from such lamps within the desired range of CCT of about 3000°–5000° K and CRI of greater than about 80.

Relatively high CRI (>80) has been realized in metal halide lamps having a CCT in the desired range by the selection of various metal halide combinations comprising the lamp fill material. For example, U.S. Pat. No. 5,694,002 to Krasko et al. discloses a metal halide lamp having a quartz arc tube with a fill of halides of sodium, scandium, lithium, and rare earth metals, which operates at a CCT of about 3000° K and a CRI of about 85. U.S. Pat. No. 5,751,111 to Stoffels et al. discloses a metal halide lamp having a ceramic arc tube with a fill of halides of sodium, thallium and rare earth metals which operates at a CCT of about 3000° K and a CRI of about 82. However, the quartz lamps disclosed by Krasko et al. have a relatively low LPW, the ceramic lamps disclosed by Stoffels et al. are relatively expensive to produce, and both types of lamps have a relatively high variability in operating parameters and a relatively diminished useful operating life.

The use of a sodium/scandium based halide fill in plasma lamps has addressed the efficiency and variability problems by providing improved efficiency and lower variability in operating parameters relative to metal halide lamps having other fill materials. However, such lamps have a relatively low CRI of about 65–70 and thus are not suitable for many applications.

One known approach in improving certain operating characteristics of plasma lamps is to filter the light emitted from the plasma using thin film coatings. It is a characteristic of such coatings that they selectively reflect and/or absorb radiation at selected wavelengths. For example, U.S. Pat. No. 5,552,671 to Parham et al. discloses a multilayer UV radiation absorbing coating on the arc tubes of metal halide lamps to block UV radiation. U.S. Pat. No. 5,646,472 to Horikoshi discloses a metal halide lamp having a dysprosium based fill with a multilayer coating on the arc tube for reflecting light at wavelengths shorter than nearly 600 nm while transmitting light at longer wavelengths to lower the CCT of the lamp. However, the optimal utilization of thin film coatings to control certain operating characteristics of plasma lamps often requires that a significant portion of the light that is selectively reflected by the coating be absorbed by the plasma, and there remains a need for thin film coatings for plasma lamps directed to plasma absorption.

One known approach in improving certain operating characteristics of filament lamps such as tungsten halogen lamps is to filter the light emitted from the filament using glass containing filtering dopants. U.S. Pat. No. 6,323,585 to Crane et al. and assigned to Corning Incorporated discloses a family of glasses that absorb ultraviolet ("UV") radiation and filter yellow light in the visible spectrum. These glasses have found utility in forming lamp envelopes and filters in filament lamps. U.S. Pat. No. 4,315,186 to Hirano et al. and U.S. Pat. No. 5,548,491 to Karpen also disclose the use of doped glass for forming the front lens in filament automobile headlamps. However, the filters formed by these doped glasses actually reduce the CRI of the light emitted by the filament lamps. There is no known use prior to the present invention of these glasses to filter the light generated from plasma lamps generally, and specifically metal halide lamps having a sodium/scandium fill.

There remains a need for plasma lamps with high efficacy, high CRI, and a desirable CCT with improved color consistency from lamp to lamp.

It is accordingly an object of the present invention to obviate many of the deficiencies of the prior art.

Another object of the present invention is to improve the CRI of plasma lamps by using filters formed from doped glass.

Still another object of the present invention is to provide novel lamp components in plasma lamps formed from doped glass.

Yet another object of the present invention is to provide a novel plasma lamp with improved operating characteristics and method of manufacturing such plasma lamps.

Still yet another object of the present invention to provide a novel plasma lamp and method using doped glass to obtain the desired spectral emission characteristics for the lamp.

A further object of the present invention is to provide a novel plasma lamp and method of making plasma lamp with operating characteristics suitable for indoor retail and display lighting.

Yet a further object of the present invention to provide a novel metal halide lamp and method having a highly selective notch in transmissivity.

It is still another object of the present invention to provide a novel sodium/scandium lamp and method.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

The present invention finds utility in the manufacture of all types and sizes of plasma lamps. As discussed above, plasma lamps have found widespread acceptance in many lighting applications, but the use of plasma lamps in some applications may be limited due to the difficulty in realizing the desired spectral emission characteristics of the light emitting plasma in such lamps. It has been discovered that glass containing dopants such as the family of glasses disclosed in U.S. Pat. No. 6,323,585 may be used to form a filter in plasma lamps provide a means for obtaining the desired spectral emission characteristics while maintaining or improving the overall operating characteristics of plasma. By way of example only, certain aspects of the present invention will be described in connection with obtaining the desired spectral emission characteristics in sodium/scandium metal halide lamps to raise the CRI of such lamps.

Figure 1:
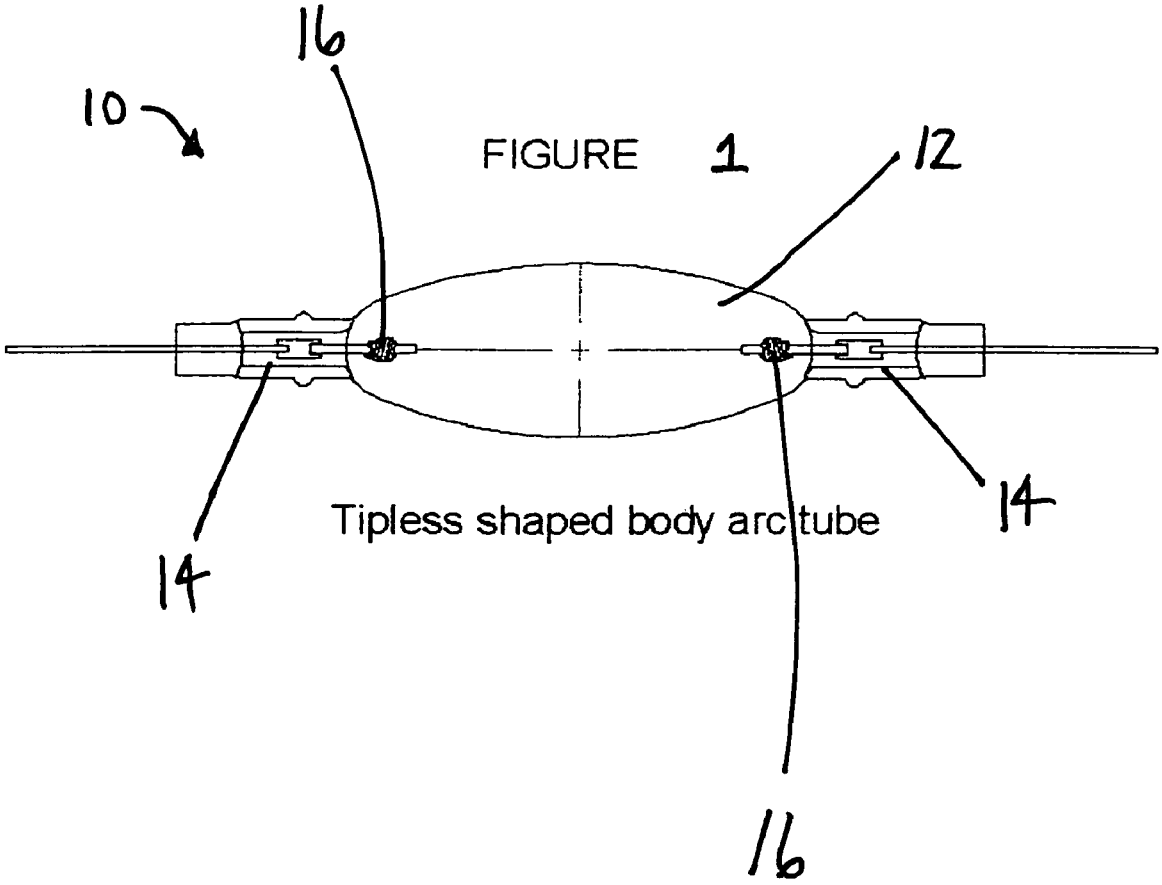
FIG. 1 is an illustration of a formed body arc tube for plasma lamps.

FIG. 1 illustrates a formed body arc tube suitable for use in sodium/scandium metal halide lamps. With reference to FIG. 1, the arc tube 10 is formed from light transmissive material such as quartz. The arc tube 10 forms a bulbous chamber 12 intermediate pinched end portions 14. A pair of spaced apart electrodes 16 are sealed in the arc tube, one in each of the pinched end portions 14. The chamber 12 contains a fill gas, mercury, and one or more metal halides.

During operation of the lamp, an arc is struck between the electrodes 16 that vaporizes the fill materials to form a light emitting plasma. According to the present invention, a surface in the lamp which substantially surrounds the plasma, e.g., the arc tube, an arc tube shroud, the outer lamp envelope, or a reflector, may be formed from a doped glass to form a notch filter.

To obtain a desired spectral emission from a plasma lamp using a filter, the target spectral emission lines must be identified by analysis of the unfiltered spectral emission of the lamp. The filter must then be designed so that desired portions of the light emitted by the plasma at the target wavelengths are absorbed by or reflected by the filter and absorbed in the plasma to thereby selectively remove such light from the light transmitted from the lamp.

Once the target spectral lines have been identified, the physical dimensions of the specific arc in the plasma that primarily emit the light at each targeted wavelength are measured to determine the region within the plasma that the reflected light must be directed for absorption.

The spectral absorption characteristics of the plasma are then determined either theoretically by consideration of arc temperature and the densities of the mercury and metal halides, or experimentally based on measured spectral emittance changes caused by the application of highly reflective coatings to the arc tube.

The angular distribution of the light emitted from the plasma on the filter must also be determined so that the angle of incidence may be considered in the coating design. The geometry of the filter (i.e. the coated surface), and the physical dimensions of the plasma may be used to determine the angular distribution of the emitted light at each point on the filter.

In view of the dimensions of the plasma and the angular distribution of the emitted light on the filter, the absorption of light in the plasma as a function of the reflectivity of the filter may be predicted. The reflectivity levels at each spectral emission wavelength of interest for the filter may then be targeted to obtain the desired spectral transmission from the lamp.

A typical sodium/scandium metal halide lamps includes a fill comprising a fill gas selected from the gases neon, argon, krypton, or a combination thereof, mercury, and halides of sodium and scandium. The fill material may also include one or more additional halides of metals such as thorium and metals such as scandium and cadmium.

According to one aspect of the present invention directed to raising the CRI of sodium/scandium metal halide lamps, it has been determined that the CRI of the light transmitted by a notch filter that transmits light in the visible spectrum except in a narrow range near 580 nm where the transmission is reduced is greater than the CRI of the light generated by the plasma. For example, the filter may reflect at least seventy percent of the light emitted by the plasma in a narrow wavelength band (about 550 nm to about 620 nm) in the visible spectrum (about 380 nm to about 760 nm) and transmit at least seventy percent of the light emitted from the plasma in the visible spectrum and outside of the narrow band. (Note that the percentages of light transmitted or reflected relate to the average transmission/reflection of light within the identified band and not the specific transmission/reflection of light at each wavelength in the band.)

A suitable notch filter may be formed by using doped glass to form a surface in the lamp which substantially surrounds the light emitting plasma. Glass containing neodymium oxide provides suitable filtering characteristics to raise the CRI in a sodium/scandium metal halide lamp. The glass forms a filter that reduces the transmission of yellow light thus accentuating the transmission of the blue and red components of the light thereby enhancing the CRI of the light. Glass further containing cerium oxide may be used to provide the additional benefits of filtering UV radiation.

Figure 2:
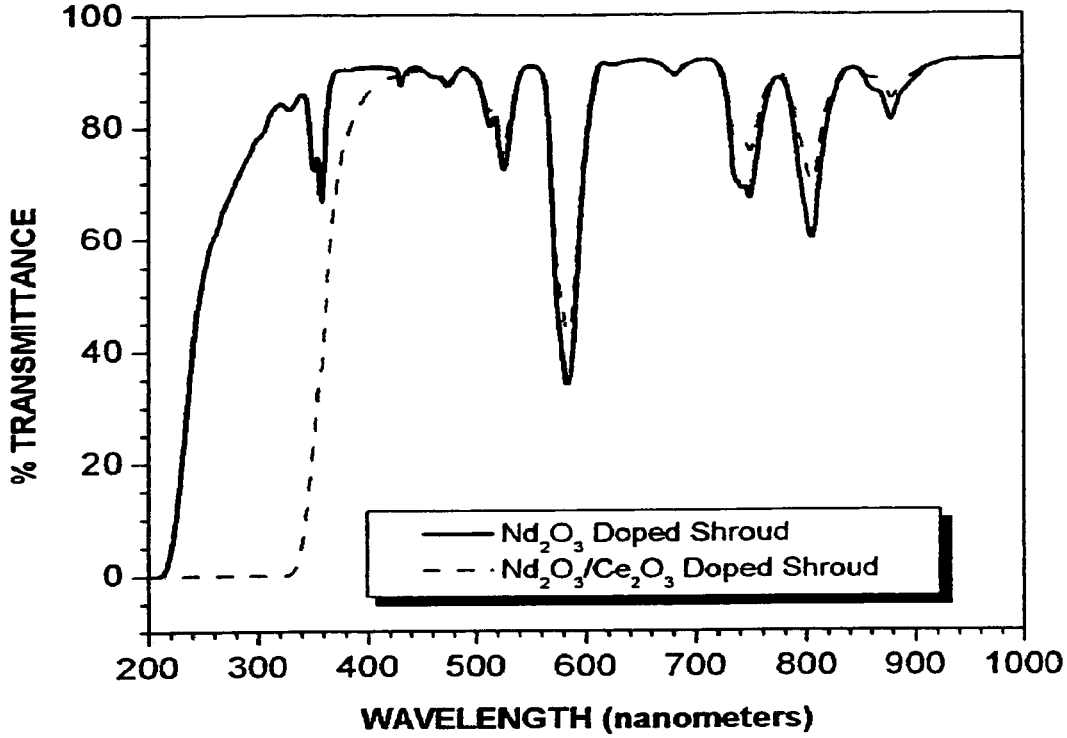
FIG. 2 is an illustration of the transmissivity characteristics of a lamp according to one aspect of the present invention.
Figure 3:
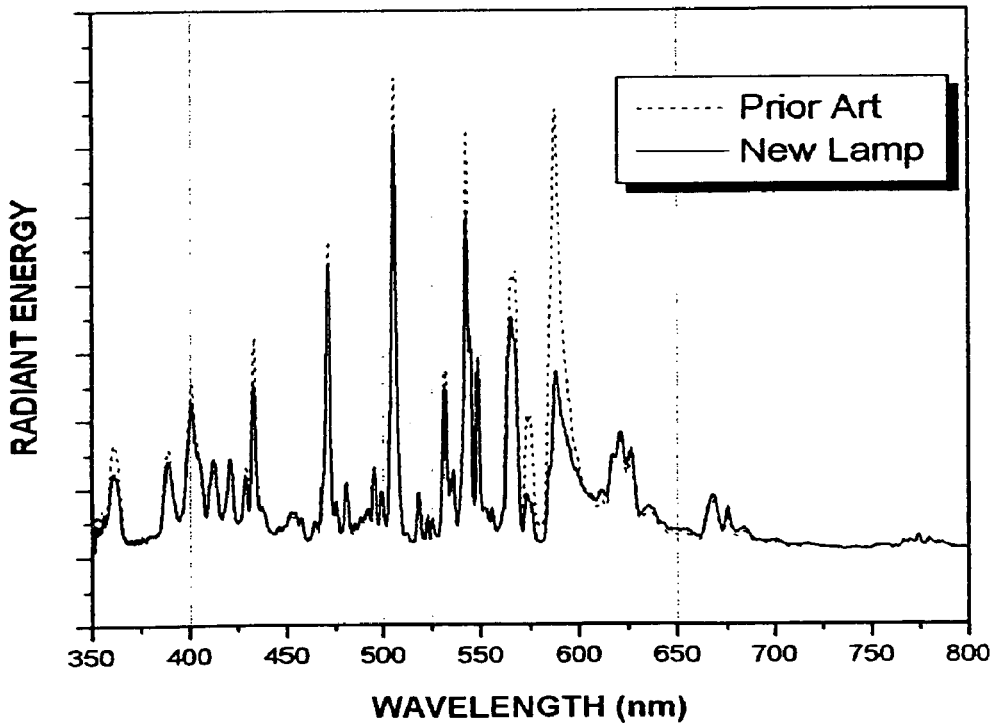
FIG. 3 is an illustration comparing the transmissivity characteristics of a lamp a filter according to one aspect of the present invention and a filterless lamp.

By way of example, FIG. 2 illustrates the transmittance of 100 watt lamps having doped quartz shrouds according to the present invention. FIG. 3 illustrates a comparison of the transmittance from the lamp illustrated in FIG. 2 with a doped shroud to the same lamp having a shroud formed from undoped glass. Thus according to one aspect of the present invention, the CRI of a sodium/scandium lamp may be raised by 15–20 points while maintaining a relatively efficient lamp.

Figure 4:
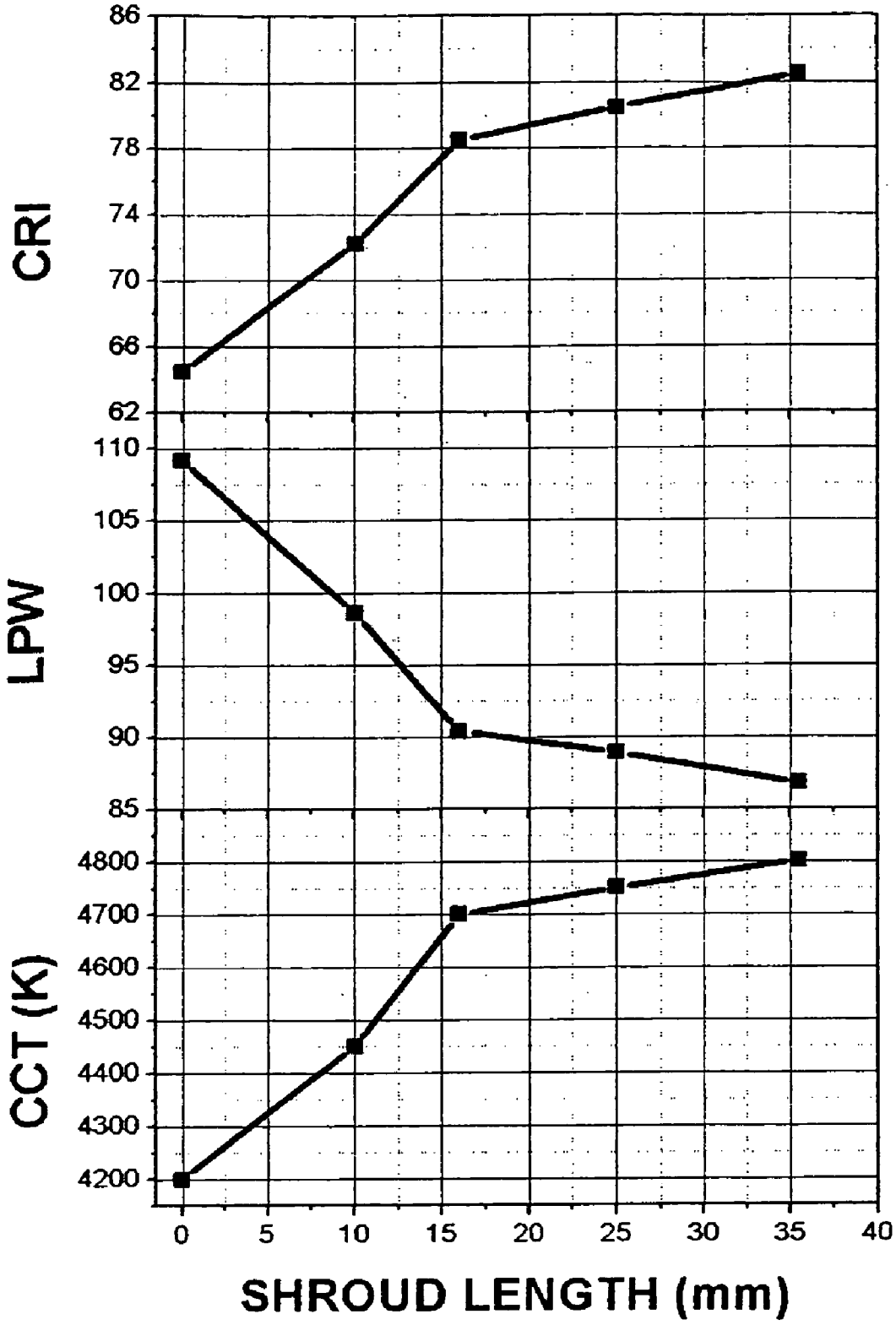
FIG. 4 is an illustration of the variability of the CRI and CCT versus LPW reduction of a sodium/scandium metal halide lamp.

It has been discovered that a CRI of greater than 90 may be realized in a sodium/scandium lamp depending on the location of the reflected band in the visible spectrum. However, improvements in CRI must be obtained with consideration of any loss in lumen output of the lamp. FIG. 4 illustrates the variability of the CRI and CCT versus LPW reduction of a 100 watt sodium/scandium metal halide lamp having an arc tube surrounded by a neodymium/cerium doped shroud according to one aspect of the present invention.

While preferred embodiments of the present invention have been described, the embodiments described are illustrative only and the scope of the invention is defined solely by the appended claims when accorded a full range of equivalence, many variations and modifications naturally occurring to those skilled in the art from a perusal hereof.

What is claimed:

1. A lamp comprising halides of:

an arc tube containing a light emitting plasma comprising sodium and scandium; and a filter for absorbing or reflecting at least a portion of the light emitted from said plasma in the visible spectrum, said filter comprising a vitreous material containing neodymium oxide.

2. The lamp of claim 1 wherein the fill material further comprises a halide of thorium.

3. The lamp of claim 1 wherein said filter absorbs or reflects light in a narrow wavelength band in the visible spectrum.

4. The lamp of claim 3 wherein the narrow wavelength band is substantially centered at 580 nm.

5. The lamp of claim 1 wherein said vitreous material contains comprises cerium oxide.

6. The lamp of claim 1 wherein said filter forms a protective shroud substantially surrounding said arc tube.

7. The lamp of claim 1 wherein said filter forms an outer lamp jacket substantially surrounding said arc tube.

8. The lamp of claim 1 wherein said filter forms the arc tube.

9. The lamp of claim 1 wherein said filter forms a reflector.

10. The lamp of claim 1 wherein the color rendering index of the light transmitted by the filter is greater than the color rendering index of the light emitted from the plasma.

11. The lamp of claim 1 wherein the color rendering index of the light transmitted by the filter is greater than about 65.

12. The lamp of claim 1 wherein the operating characteristics of said lamp include a lumens per watt greater than about 70, a color rendering index greater than about 65, and a correlated color temperature between about 3000° K and about 6000° K.

13. The lamp of claim 12 wherein the operating characteristics of said lamp include a lumens per watt greater than about 85, a color rendering index greater than about 80, and a correlated color temperature between about 3000° K and about 6000° K.

14. A high intensity discharge lamp having a vaporizable fill material comprising halides of sodium and scandium and a filtering material comprising a vitreous material containing neodymium oxide.

15. The lamp of claim 14 wherein the operating characteristics of said lamp include a lumens per watt greater than about 70, a color rendering index greater than about 65, and a correlated color temperature between about 3000° K and about 6000° K.

16. The lamp of claim 15 wherein the operating characteristics of said lamp include a lumens per watt greater than about 85, a color rendering index greater than about 80, and a correlated color temperature between about 3000° K and about 6000° K.

17. The lamp of claim 14 comprising an arc tube formed from said filtering material.

18. The lamp of claim 14 comprising an outer lamp envelope formed from said filtering material.

19. The lamp of claim 14 comprising a protective shroud formed from said filtering material.

20. The lamp of claim 14 wherein the filtering material forms a filter which absorbs or reflects at least seventy percent of the light generated by the lamp within a narrow wavelength band in the visible spectrum and transmits at least seventy percent of the light generated by the lamp within the visible spectrum and outside of said narrow band.

21. The high intensity discharge lamp of claim 14 wherein the fill material further comprises a halide of thorium.

22. The high intensity discharge lamp of claim 14 wherein said filtering material comprises cerium oxide.

23. In a lamp having a light emitting plasma containing halides of sodium and scandium, a method of increasing the color rendering index of the light provided by the lamp comprising the step of filtering a substantial portion of the light emitted from the plasma with a filter formed from a vitreous material containing neodymium oxide.

24. The method of claim 23 comprising the step of forming the arc tube from the vitreous material containing neodymium oxide.

25. The method of claim 23 comprising the step of forming a protective shroud from the vitreous material containing neodymium oxide.

26. The method of claim 23 comprising the step of forming the outer lamp envelope from the vitreous material containing neodymium oxide.

27. A lamp comprising:

an arc tube forming a chamber;

a vaporizable fill material comprising one or more halides of sodium and scandium contained within said chamber, said fill material forming a light emitting plasma during operation of the lamp; and a notch filter formed from a vitreous material containing neodymium oxide for filtering light emitted from the plasma so that the color rendering index of the light transmitted by the filter is greater than the color rendering index of the light emitted from the plasma.

28. A method of making a high intensity discharge lamp having a vaporizable fill material of one or more metal halides forming a light emitting plasma during operation of the lamp, said method comprising the steps of:

selecting a fill material comprising halides of sodium and scandium; and filtering the light emitted from the plasma with a vitreous material containing neodymium oxide so that the operating characteristics of said lamp include a lumens per watt greater than about 70, a color rendering index greater than about 65, and a correlated color temperature between about 3000° K and about 6000° K.

29. The method of claim 28 wherein the fill material further comprises a halide of thorium.

30. The method of claim 28 wherein the operating characteristics of said lamp include a lumens per watt greater than about 85, a color rendering index greater than about 80.

31. A method of raising the CRI of a lamp having an arc tube containing a light emitting plasma wherein the plasma comprises halides of sodium and scandium, said method comprising the step of filtering light emitted from the plasma with a filter formed from a vitreous material containing neodymium oxide so that no more than thirty percent of the light within a narrow wavelength band in the visible spectrum is transmitted and more than seventy percent of the light within the visible spectrum and outside of the narrow band is transmitted.

* * * * *